US007237399B2

(12) United States Patent
Iguchi et al.

(10) Patent No.: US 7,237,399 B2
(45) Date of Patent: Jul. 3, 2007

(54) COLD STORAGE

(75) Inventors: Harunobu Iguchi, Ota (JP); Yuji Yonehara, Ora-gun (JP); Kazuo Tetsukawa, Isesaki (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 106 days.

(21) Appl. No.: 11/131,310

(22) Filed: May 18, 2005

(65) Prior Publication Data

US 2005/0262863 A1 Dec. 1, 2005

(30) Foreign Application Priority Data

May 27, 2004 (JP) ..... 2004-157477

(51) Int. Cl.
*A47F 3/04* (2006.01)

(52) U.S. Cl. ..... 62/255; 62/298

(58) Field of Classification Search ..... 62/246–256, 62/298

See application file for complete search history.

(56) References Cited

U.S. PATENT DOCUMENTS

| | | | | |
|---|---|---|---|---|
| 3,206,943 A | | 9/1965 | Rice et al. | 62/302 |
| 4,949,554 A | * | 8/1990 | Branz et al. | 62/248 |
| 5,347,827 A | * | 9/1994 | Rudick et al. | 62/440 |
| 5,417,079 A | * | 5/1995 | Rudick et al. | 62/253 |
| 5,417,081 A | * | 5/1995 | Rudick et al. | 62/440 |
| 6,948,324 B2 | * | 9/2005 | Jin | 62/77 |
| 2002/0124590 A1 | | 9/2002 | Rudick | 62/448 |

FOREIGN PATENT DOCUMENTS

| | | |
|---|---|---|
| JP | 2000-105058 | 4/2000 |
| WO | WO 95/08087 | 3/1995 |

* cited by examiner

*Primary Examiner*—William E. Tapolcai
(74) *Attorney, Agent, or Firm*—Armstrong, Kratz, Quintos, Hanson & Brooks, LLP

(57) ABSTRACT

The present invention intends to provide a cold storage in which a cooling unit constituted by integrating a compressor, an evaporator and the like is mounted on a bottom part of an insulating box, whereby processing of the cooling unit on its insulating box side is made unnecessary or minimum, and a space can also be saved. The cold storage comprises a cooling unit in which a cooling box receiving an evaporator and a blower in a cooling chamber having an opened upper surface, a compressor, a condenser and the like are integrally disposed on a mounting base; and a cold air outlet and a cold air inlet formed in a bottom wall of the insulating box which becomes a ceiling of the machine chamber to communicate the inside of the storing chamber with the inside of the machine chamber, the cooling unit being provided with a push-up mechanism which is disposed to downwardly project from the mounting base, thereby pushing up the cooling unit toward the bottom wall, and to bring the cooling box into close contact with the bottom wall, thereby communicating the cold air outlet and the cold air inlet with the inside of the cooling chamber.

13 Claims, 10 Drawing Sheets

COLD STORAGE

BACKGROUND OF THE INVENTION

The present invention relates to a cold storage in which a cooling unit constituted of a compressor and an evaporator is incorporated below an insulating box having a storing chamber disposed therein.

The cold storage of this type conventionally used as a low-temperature showcase comprises a machine chamber disposed below the storing chamber in the insulating box, and a cold air outlet and a cold air inlet formed in a bottom wall of the insulating box to communicate with the inside of the machine chamber. In the machine chamber, a cooling box having an opening in its upper surface is disposed to abut on the bottom wall of the insulating box. In the cooling box, an evaporator and a blower for the evaporator constituting a cooling unit are arranged. The inside of the storing chamber and the cooling box are communicated with each other via the cold air inlet and the cold air outlet. Below the cooling box of the machine chamber, a compressor, a condenser, a blower for the condenser, and the like constituting the cooling unit together with the evaporator are installed on a mounting base equipped with casters for movement on its bottom surface, thereby constituting a well-known refrigerant circuit.

The cooling box is disposed on the mounting base, and detachably attached to the bottom wall of the insulating box. The cooling box, the evaporator, the blower for the evaporator, the compressor, the condenser, and the like can be freely taken in/out of the machine chamber together with the mounting base by using the casters, and the cooling unit can be separated from the insulating box (e.g., see Japanese Patent Application Laid-Open No. 2000-105058).

However, with the aforementioned configuration, cold air leaks from a space generated between the upper surface opening of the cooling box and the cold air outlet or inlet, necessitating lifting of the cooling box including the evaporator and the blower for the evaporator therein and its fixing to the bottom wall of the insulating box by fixtures after the mounting base is received in the machine chamber. Thus, there is a problem of complex attaching work of the cooling unit. In this case, the cooling box must be fixed in positions corresponding to the cold air inlet and the cold air outlet formed in the bottom wall of the insulating box, making positioning difficult. Thus, there is a problem of more deteriorated workability.

Conventionally, therefore, a mechanism has been developed in which a suspension rail is disposed in a bottom wall lower surface of an insulating box, a support rail is disposed on a side face of a cooling box fixed to a mounting base, and a cooling unit is lifted to the bottom wall side of the insulating box in a suspended state of the support rail from the suspension rail. With this mechanism, however, a large structure such as the suspension rail must be added on the bottom wall side of the insulating box in accordance with sizes of various machines, reducing versatility to cause a cost increase and a problem of securing a space in a machine chamber.

SUMMARY OF THE INVENTION

The present invention has been made to solve the aforementioned conventional technical problems, and it is an object of the present invention to provide a cold storage in which a cooling unit constituted by integrating a compressor, an evaporator and the like is mounted on a bottom part of an insulating box, whereby processing of the cooling unit on its insulating box side is made unnecessary or minimum, and a space can also be saved.

A first aspect of the present invention is directed to a cold storage in which a machine chamber is disposed below a storing chamber in an insulating box, and the cold storage comprises a cooling unit in which a cooling box receiving an evaporator and a blower in a cooling chamber having an opened upper surface, a compressor, a condenser and the like are integrally disposed on a mounting base; and a cold air outlet and a cold air inlet formed in a bottom wall of the insulating box which becomes a ceiling of the machine chamber to communicate the inside of the storing chamber with the inside of the machine chamber, the cooling unit being provided with a push-up mechanism which is disposed to downwardly project from the mounting base, thereby pushing up the cooling unit toward the bottom wall, and to bring the cooling box into close contact with the bottom wall, thereby communicating the cold air outlet and the cold air inlet with the inside of the cooling chamber.

According to the invention, it is possible to cool the inside of the storing chamber by mounting the cooling unit including the compressor, the condenser, the cooling box, and the like integrated therein to the bottom wall of the insulating box without any difficulties, and forming cold air circulation of discharging cold air heat-exchanged with the evaporator through the cold air outlet into the storing chamber and sucking the cold air through the cold air inlet into the cooling chamber.

In this case, especially, the push-up mechanism downwardly projects from the mounting base to push up the cooling unit toward the bottom wall, and the cooling box is brought into close contact with the bottom wall. Thus, it is possible to make processing of the cooling box on the insulating box side unnecessary or minimum, and standards can be unified and a space can also be saved.

A second aspect of the present invention is directed to the above cold storage, wherein the push-up mechanism is provided with holding means which holds the close contact state of the cooling box to the bottom wall.

According to the invention, additionally, the cooling box can be stably brought into close contact with and held to the insulating box. Moreover, the cooling unit is stabilized by the holding means, and thus it is possible to prevent a problem of falling of the cooling unit.

A third aspect of the present invention is directed to the above cold storage, wherein the push-up mechanism comprises support portions disposed in the mounting base, and push-up arms rotatably mounted to the support portions by lower rotary shafts and positioned on both sides of the mounting base, and each push-up arm comprises a cam face having a changeable radius from the rotary shaft and downwardly projecting from the mounting base, and the push-up arm is upright by being rotated and pushes up the cooling unit when the cam face of a portion increased in radius from the rotary shaft comes directly below the rotary shaft.

According to the invention, additionally, the rotation of the cam face of the push-up arm can be accompanied by easy and sure pushing-up of the heavy cooling unit by a simple structure based on a principle of leverage.

A fourth aspect of the present invention is directed to the above cold storage, wherein a circular-arc guide groove is formed around the rotary shaft in each support portion, and a guide shaft movably engaged with the guide groove is disposed in each push-up arm.

According to the invention, additionally, the pushing-up operation of the cooling unit by the push-up arm can be stabilized.

A fifth aspect of the present invention is directed to the above cold storage, wherein an engaging grove is continuously formed downward in one end of the guide groove, a long hole is formed in an upright state in an up-and-down direction in the push-up arm, the guide shaft is movably engaged in the long hole, and in an upright state of the push-up arm, the guide shaft is lowered, and enters the engaging groove and engages with the same.

According to the invention, additionally, the guide groove is engaged with the engaging groove in the upright state of the push-up arm and the pushed-up state of the cooling unit. Thus, the rotation of the push-up arm is regulated to stably enable close contact/hold of the cooling box on the insulating box side. Moreover, the rotation of the push-up arm is regulated in the engaged stage of the guide shaft with the engaging groove. Thus, it is possible to prevent a problem of falling of the cooling unit.

A sixth aspect of the present invention is directed to the above cold storage, wherein a friction coefficient is set large between the guide shaft and the guide groove.

According to the invention, additionally, the guide shaft cannot move suddenly in the guide groove. Thus, it is possible to prevent sudden falling of the cooling unit.

A seventh aspect of the present invention is directed to the above cold storage, wherein the push-up arms are positioned at four corners of the mounting base, and the push-up arms positioned in front and rear parts are connected to each other by a link arm.

According to the invention, additionally, the push-up arms positioned in the front and rear parts are operated in association by the link arm, the cooling units can be smoothly and stably pushed up at the four corners, and operability can be improved.

An eighth aspect of the present invention is directed to the above cold storage, further comprising a handle for operating the push-up arms positioned on both sides of the mounting base in association.

According to the invention, additionally, by operating the handle, the four corners of the cooling unit can be roughly simultaneously lifted. By disposing the handle, the single cooling unit can be easily carried.

A ninth aspect of the present invention is directed to the above cooling chamber, wherein in the other end of the guide groove, an engaging groove which the guide shaft enters is continuously formed upward, and the guide shafts are positioned in both ends of the handle.

According to the invention, additionally, both ends of the handle can be fixed by the engaging grooves, and the handle can be stabilized when the cooling unit is carried.

A tenth aspect of the present invention is directed to the above cold storage, wherein the machine chamber comprises a stopper which is positioned in a rotational direction for erecting the push-up arm, and on which the mounting base abuts in a state in which the cooling box corresponds to the cold air outlet and the cold air inlet.

According to the invention, additionally, the mounting base abuts on the stoppers to rotate the push-up arm, thereby facilitating the lifting work of the cooling unit more. Moreover, the abutment of the mounting base on the stoppers facilitates positioning of the cooling box.

An eleventh aspect of the present invention is directed to the above cold storage, wherein both lower sides of the machine chamber comprise rails on which the push-up mechanism abuts and which prevent horizontal shifting of the mounting base.

According to the invention, additionally, left-and-right positional shifting of the cooling unit can be prevented or limited to a minimum.

A twelfth aspect of the present invention is directed to the above cold storage, wherein the cooling box is supported by the condenser.

According to the invention, additionally, the condenser also serves as a support member of the cooling box. Thus, it is possible to reduce costs.

A thirteenth aspect of the present invention is directed to the above cold storage, wherein a blower for the condenser is disposed in an end of the mounting base to ventilate the condenser, and a perforated fan cover is mounted to the blower for the condenser.

According to the invention, additionally, clogging of the condenser can be prevented by the fan cover. Moreover, by the fan cover, it is possible to prevent injuries.

DETAILED DESCRIPTION OF THE PREFERRED EMBODIMENTS

Thus, the present invention has been made to solve the conventional technical problems, and provides a cold storage which can cool the inside of a storing chamber by mounting a cooling unit including a compressor, a condenser, a cooling box, and the like integrated therein to a bottom wall of an insulating box without any difficulties by a simple configuration, and forming cold air circulation of discharging cold air heat-exchanged with an evaporator through a cold air outlet into the storing chamber by a blower and sucking the cold air through a cold air inlet into a cooling chamber. Hereinafter, the preferred embodiments of the present invention will be described in detail with reference to the accompanying drawings.

(Embodiment 1)

Figure 1:
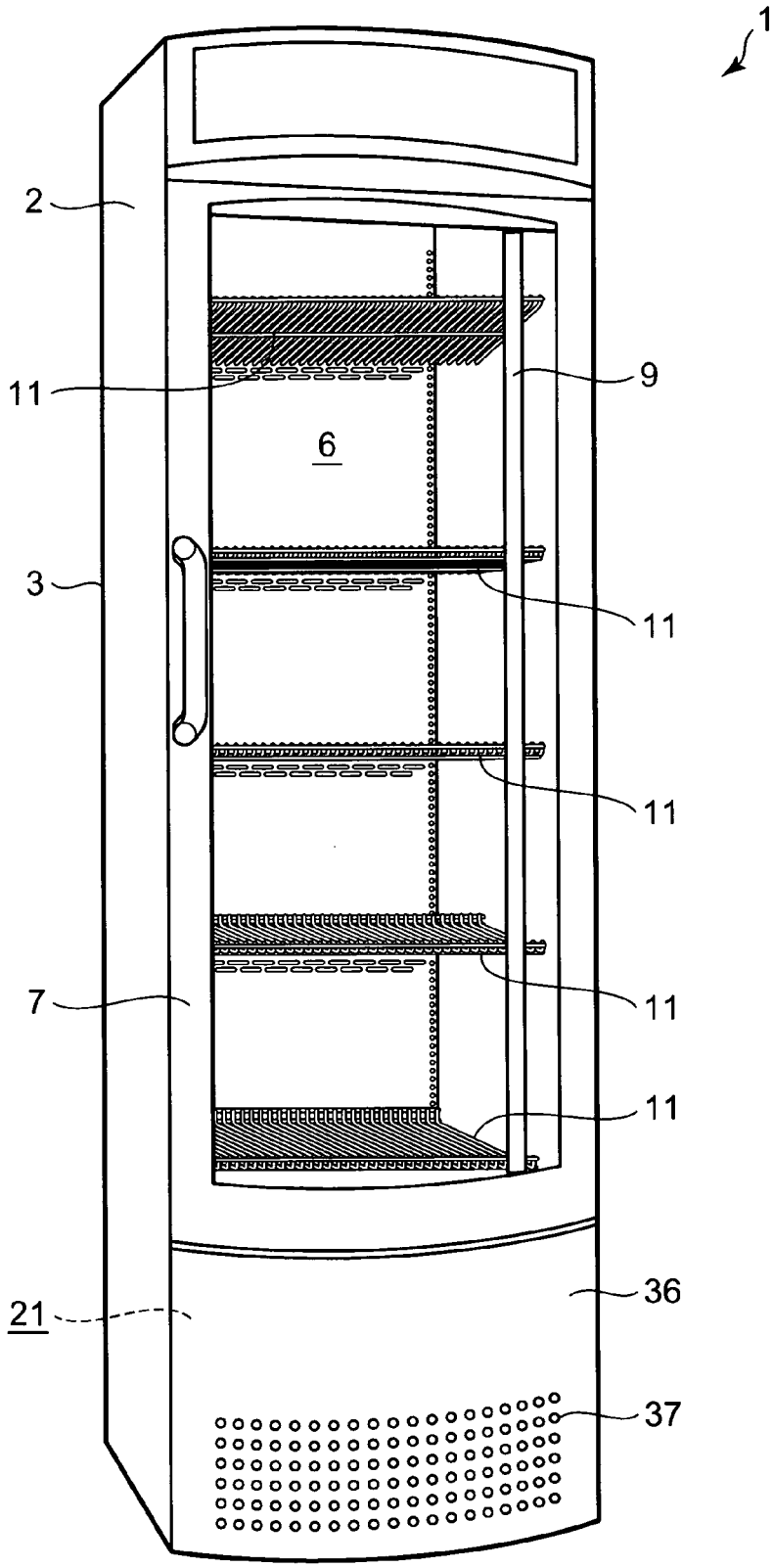
FIG. 1 is a perspective view of a cold storage to which the present invention is applied.
Figure 2:
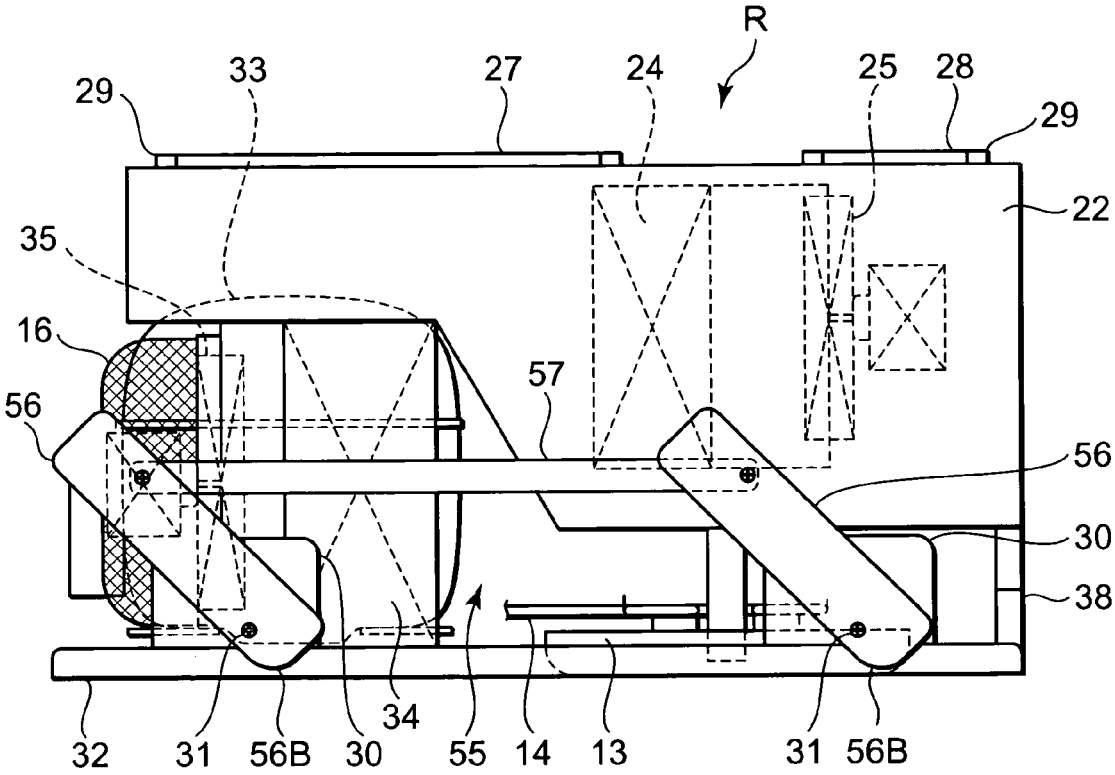
FIG. 2 is a perspective side view of a cooling unit of the cold storage of FIG. 1.
Figure 3:
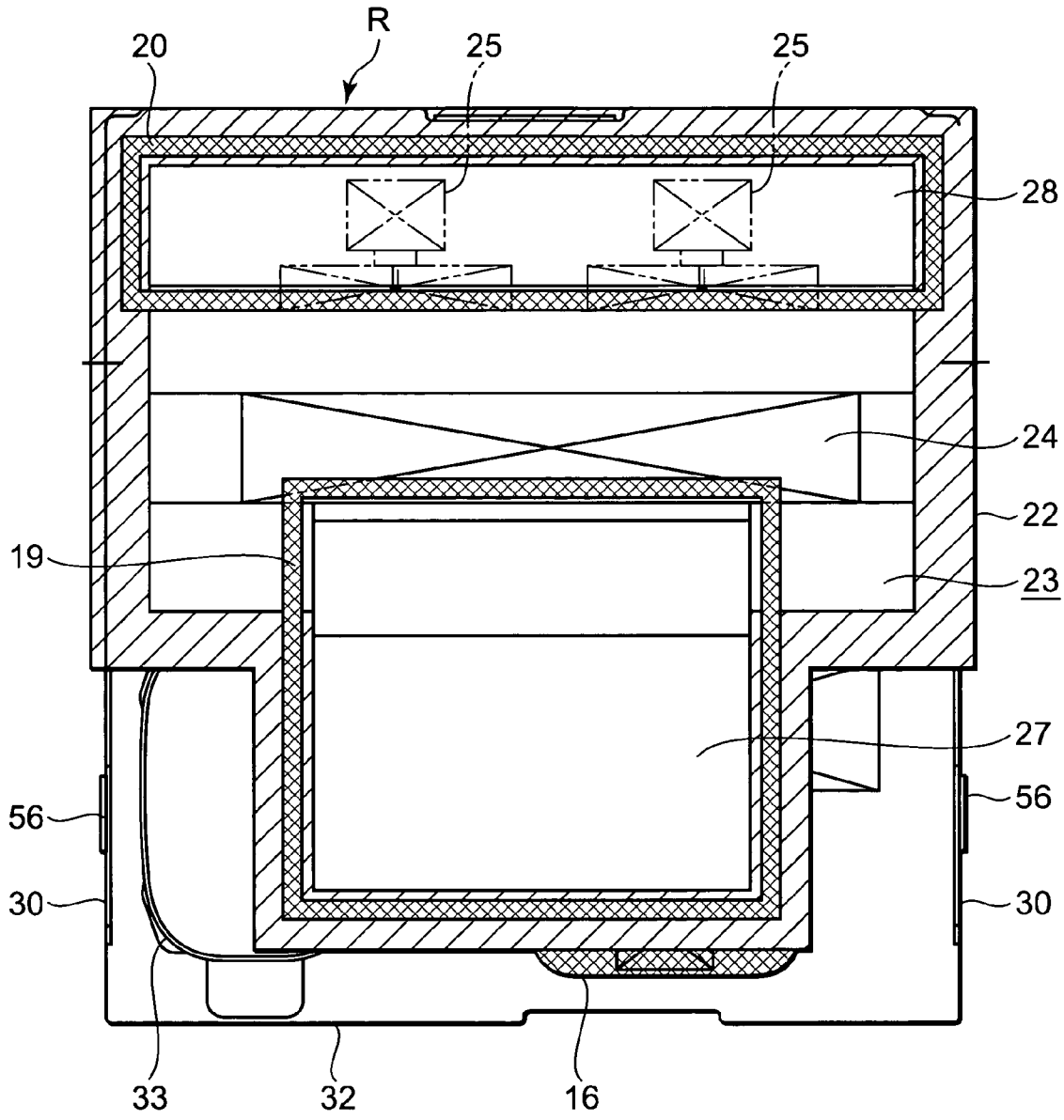
FIG. 3 is a plan view of the cooling unit.
Figure 4:
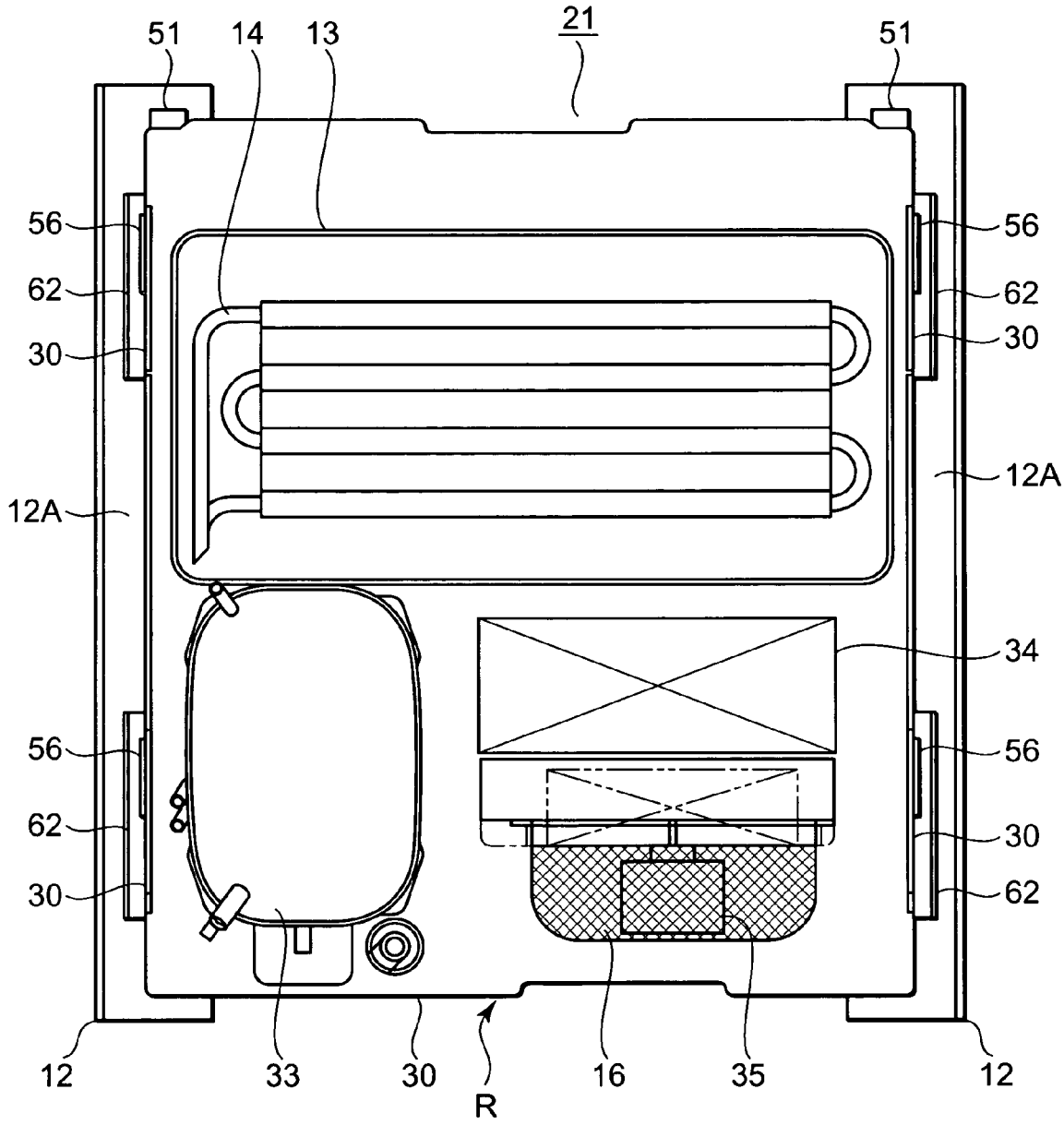
FIG. 4 is a plan sectional view of a machine chamber of the cold storage of FIG. 1.

FIG. 1 is a front view of a cold storage 1 to which the present invention is applied, FIG. 2 is a perspective side view of a cooling unit R according to an embodiment of the present invention, FIG. 3 is a plan view of the cooling unit R, and FIG. 4 is a plan sectional view of a machine chamber 21 portion of the cold storage 1. In the cold storage 1 of this embodiment, a main body comprises a rectangular insulating box 2 opened in a front face. The insulating box 2 comprises a steel-plate outer box 3 having an opening in a front face, an inner box (not shown) having an opening in a front face, and an insulating material which fills a space between the inner and outer boxes by foaming. A storing chamber 6 opened in a front face is formed in the insulating box 2, and the front opening of the storing chamber 6 is freely opened/closed by a glass door 7 through which the inside can be seen. In the storing chamber 6, a plurality of shelves 11 are installed on shelf supports 9 to mount foodstuffs, or the like thereon.

Steel-plate base leg angles 12 of predetermined thicknesses are mounted to both sides of a bottom part of the insulating box 2. Both sides of the base leg angle 12 are covered with the outer box 3 constituting the insulating box 2. Accordingly, a machine chamber 21 is formed in a lower part of the insulating box 2, and both-side bottoms and both-side front and rear parts of the machine chamber 21 are fringed with the base leg angles 12. Rails 62, 62 are mounted to front and back sides of lower parts 12A of the base leg angles 12 of both sides constituting the bottom part of the machine chamber 21. A reference numeral 36 denotes a cover for freely opening/closing a front face of the machine chamber 21, and a reference numeral 37 denotes a vent hole.

In the bottom wall of the insulating box 2, a cold air inlet 19 and a cold air outlet 20 (hatched in FIG. 3) are formed in front and rear parts in a form of penetrating the insulating material. Then, in the machine chamber 21 below the cold air inlet 19 and the cold air outlet 20, the cooling unit R constituted by integrating an evaporator 24 and a blower 25 for the evaporator in a cooling box 22, a compressor 33, a condenser 34, a blower 35 for the condenser, and the like is inserted from the front and fixed. In this case, the cooling box 22 having an opening in an upper surface is disposed to abut on a bottom wall lower surface of the insulating box 2 which becomes a ceiling of the machine room 21. A cooling chamber 23 opened in an upper surface is formed in the cooling box 22. The evaporator 24 constituting a refrigerant circuit of a cooling system is arranged in the cooling chamber 23, and the blower 25 for the evaporator is arranged behind the same.

In the upper-surface opening of the cooling box 22, a cold air inlet 27 and a cold air outlet 28 of the cooling box 22 side are formed in front and rear parts. The cold air inlet 27 and the cold air outlet 28 are disposed respectively corresponding to the cold air inlet 19 and the cold air outlet 20 formed in the bottom wall of the insulating box 2. In opening edges of the cooling box 22, sealing materials 29 are mounted to closely abut on the bottom wall lower surface of the insulating box 2. A mechanism of firmly fixing the upper surface of the cooling box 22 to the bottom wall lower surface of the insulating box 2 will be described later in detail.

A reference numeral 32 denotes a mounting base constituting a bottom part of the cooling unit R. The compressor 33 that constitutes the refrigerant circuit of the cooling system together with the evaporator 24 is installed on the left toward a front end of the mounting base 32, the condenser 34 is installed on the right, and the blower 35 for the condenser is installed to ventilate the condenser 34 in a right front edge of a front side of the condenser 34 toward the mounting base 32. An evaporating dish 13 and an evaporating pipe 14 are mounted to a rear part of the mounting base 32, and a control box (not shown), or the like are disposed.

Here, the evaporator 24 in the cooling box 22 is connected through a refrigerant pipe to the compressor 33, the condenser 34, and the like on the mounting base 32, thereby constituting the well-known refrigerant circuit. The cooling box 22 is positioned above the evaporating dish 13, both sides of its rear part are mounted to the mounting base 32 by a cooling box support tool 38, and its front end is mounted on the condenser 34, supported, and fixed. Then, the cooling unit R constituted by integrally installing the cooling box 22 (incorporating the evaporator 24 and the blower 25 for the evaporator), the compressor 33, the condenser 34, the blower 35 for the condenser, and the like on the mounting base 32 can be received in the machine chamber 21 from the front by opening the cover 36, and pulled forward out of the machine chamber 21.

The blower 35 for the condenser is positioned in a front end of the machine chamber 21 in a received state of the cooling unit R in the machine chamber 21. Accordingly, maintenance such as replacement of the blower 35 for the condenser is facilitated. A perforated fan cover 16 is mounted to a front face of the blower 35 for the condenser. Thus, clogging of the condenser 34 can be prevented, and injuries can be prevented by the fan cover 16.

Figure 5:
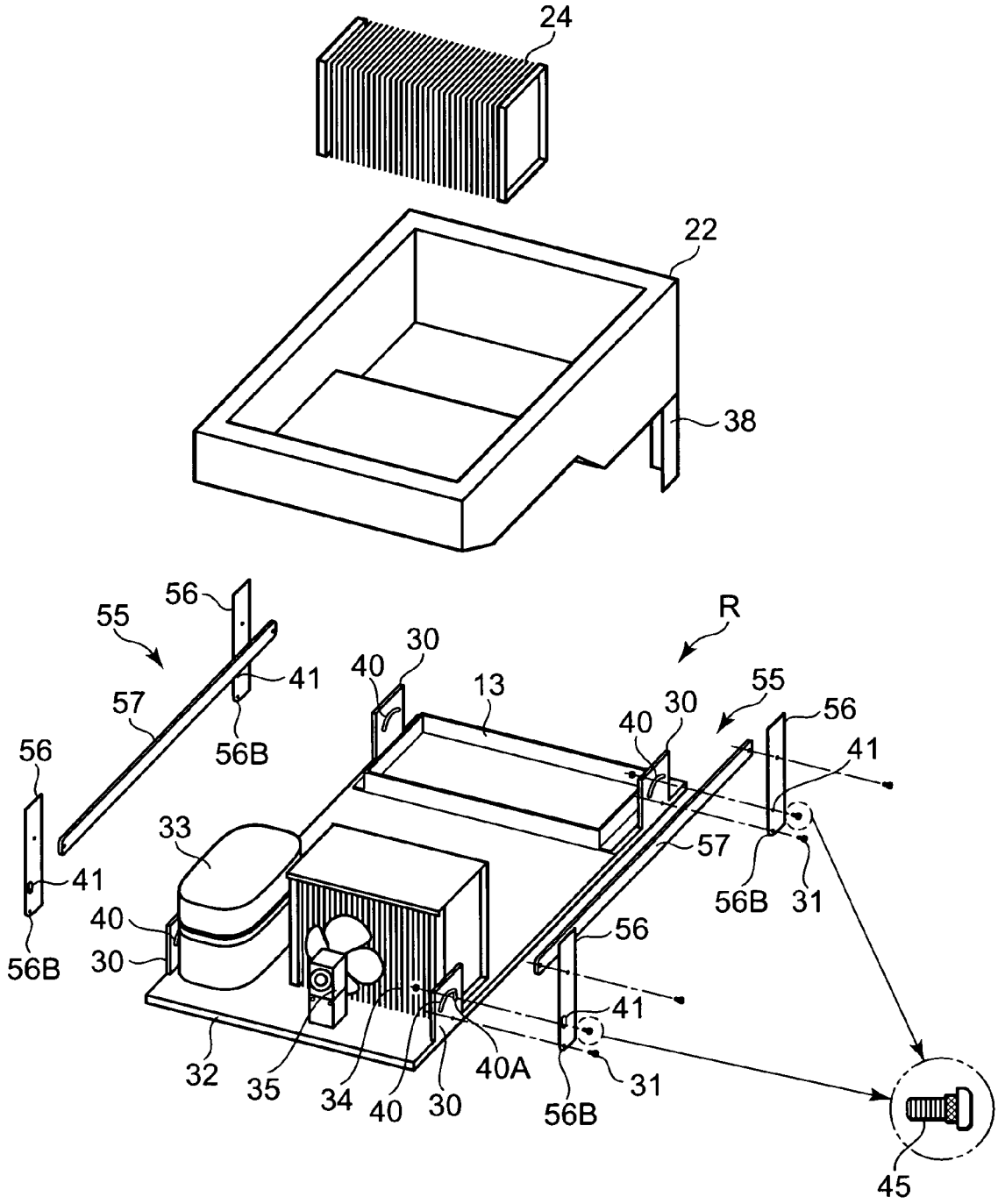
FIG. 5 is an exploded perspective view of the cooling unit of FIG. 2.

Next, referring to FIGS. 2 to 9, the mechanism of firmly fixing the cooling unit R to the bottom wall lower surface of the insulating box 2 will be described. FIG. 5 is an exploded perspective view of the cooling unit R. The mechanism of firmly fixing the cooling unit R to the bottom wall lower surface of the insulating box 2 comprises a push-up mechanism 55. According to the embodiment, the push-up mechanism 55 comprises totally four push-up arms 56, two each being mounted to front and rear parts of both sides of the mounting base 32 (i.e., four corners of the mounting base 32), and link arms 57 or the like for rotating the push-up arms 56, 56 positioned in the front and rear parts of both sides in association. Each push-up arm 56 is an arm member made of a thick steel plate having a predetermined length. Additionally, support portions 30 are formed upright in front and rear parts of both sides of the mounting base 32 (i.e., four corners of the mounting base 32). Each push-up arm 56 is positioned outside each support portion 30, and its front lower part is pivotally supported by a rotary shaft 31 so as to be rotated.

Figure 6:
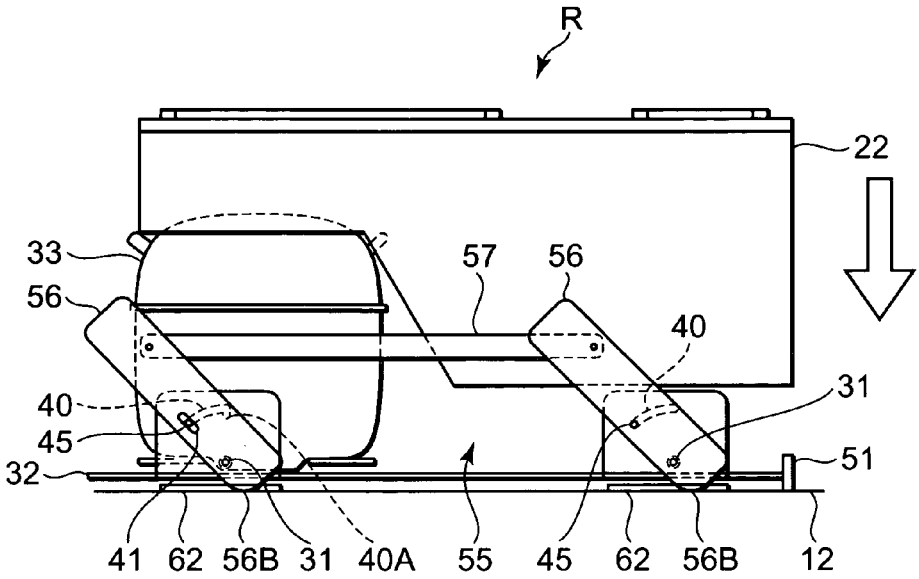
FIG. 6 is a side view of a lowered state of the cooling unit of FIG. 2.
Figure 7:
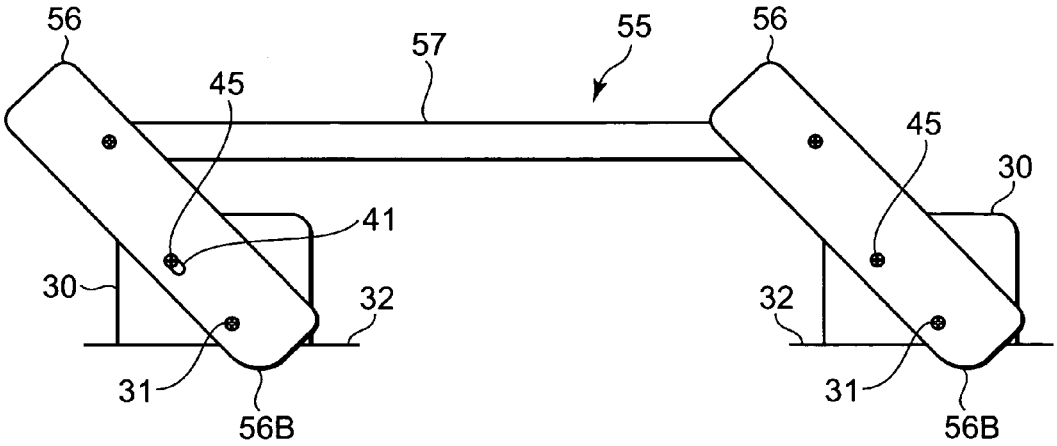
FIG. 7 is a side view of an inclined state of a push-up arm of a push-up mechanism of the cooling unit of FIG. 2.

A circular-arc cam face 56B is formed in a lower end front corner of each push-up arm 56. This cam face 56B is formed so that its radius from the rotary shaft 31 can be larger as the push-up arm 56 is rotated clockwise around the rotary shaft 31 shown in FIG. 2. Accordingly, in a state in which an upper part of each push-up arm 56 is inclined forward as shown in FIGS. 6 and 7, the cam face 56B is received above a bottom surface of the mounting base 32 as shown in FIG. 2, and rotated clockwise around the rotary shaft 31 shown in FIG. 2 to erect each push-up arm 56. When the cam face 56B comes directly below the rotary shaft 31 in which the radius from the rotary shaft 31 is largest, the cam face 56B of the push-up arm 56 downwardly projects from the mounting base 32 by an amount equal to an increase in radius. The projection of the push-up arm 56 causes lifting of the cooling unit R to the bottom wall side of the insulating box 2 as described later.

A circular-arc guide groove 40 is formed around the rotary shaft 31 to penetrate each support portion 30. Especially, in a rear end of the guide groove 40 formed in each of the support portions of both front sides, an engaging groove 40A (constituting holding means) is continuously formed vertically downward directly above the rotary shaft 31. On the other hand, in the push-up arm 56, a through-hole 41 is formed in a position directly above the rotary shaft 31 in an upright state. Especially, through-holes 41 of the push-up arms 56, 56 of both front sides are long holes (constituting holding means) in an up-and-down direction in upright states. A guide shaft 45 (constituting holding means) constituted of a grooved screw is inserted into the through-hole 41 and engaged therewith. This guide shaft 45 is movably engaged with the guide groove 40 (including the engaging groove 40A). The guide shaft 45 is movably engaged with the through-hole 41 (long hole) of the front push-up arm 56, and a friction coefficient between the guide shaft 45 and the circular-arc guide groove 40 is set large.

The link arm 57 is rotatably connected to the front and rear push-up arms 56, 56, and has a length so that rotational angles of the push-up arms 56, 56 can be equal. Since the front and rear push-up arms 56, 56 are connected to each other by the link arm 57, by operating the front push-up arm 56, the rear push-up arm 56 can be smoothly operated in association.

Next, the operations of receiving the cooling unit R in the machine chamber 21 and pushing it up to the insulating box 2 will be described. First, as shown in FIGS. 2 and 6, the cooling unit R is inserted into the machine chamber 21 from the front in a state in which an upper part of each push-up arm 56 is inclined forward. At this time, the mounting base 32 is inserted to mount the rail 62 of the lower side 12A of the base leg angle 12. By this rail 62, left-and-right positional shifting (horizontal shifting) of the mounting base 32 is prevented or suppressed. Stoppers 51, 51 are formed upright in rear parts of the lower sides 12A, 12A (directions for erecting and rotating the push-up arms 56). At a point of time when the mounting base 32 is inserted up to a predetermined position, its rear end abuts on the stoppers 51, 51 to stop.

At a point of this time, the cold air inlet 27 and the cold air outlet 28 of the cooling box 22 correspond to bottom sides of the cold air inlet 19 and the cold air outlet 20 formed in the bottom wall of the insulating box 2, and thus the mounting base 32 is positioned. The push-up arm 56 is positioned on each rail 62.

Figure 8:
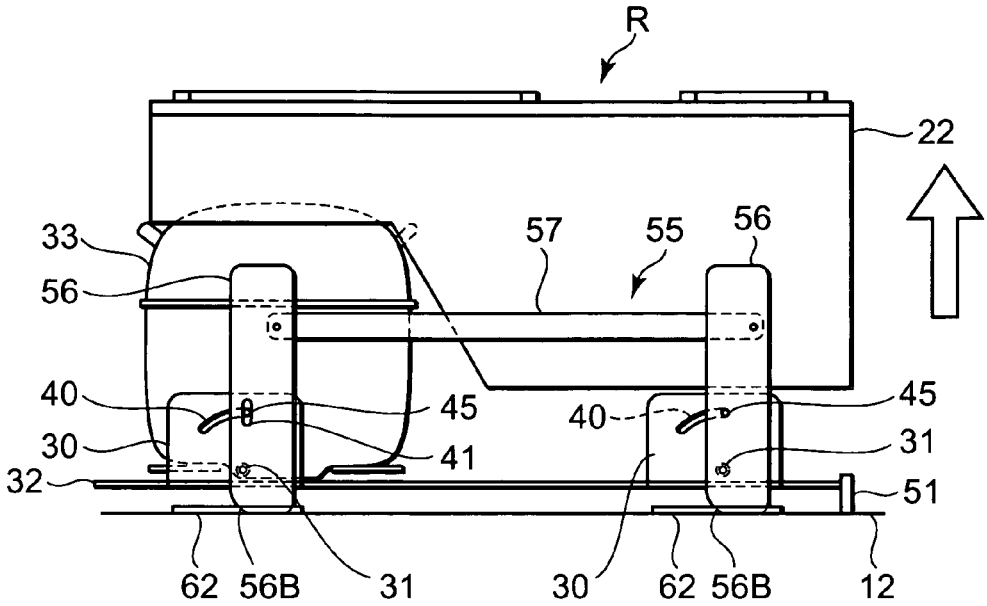
FIG. 8 is a side view of a raised state of the cooling unit of FIG. 2.
Figure 9:
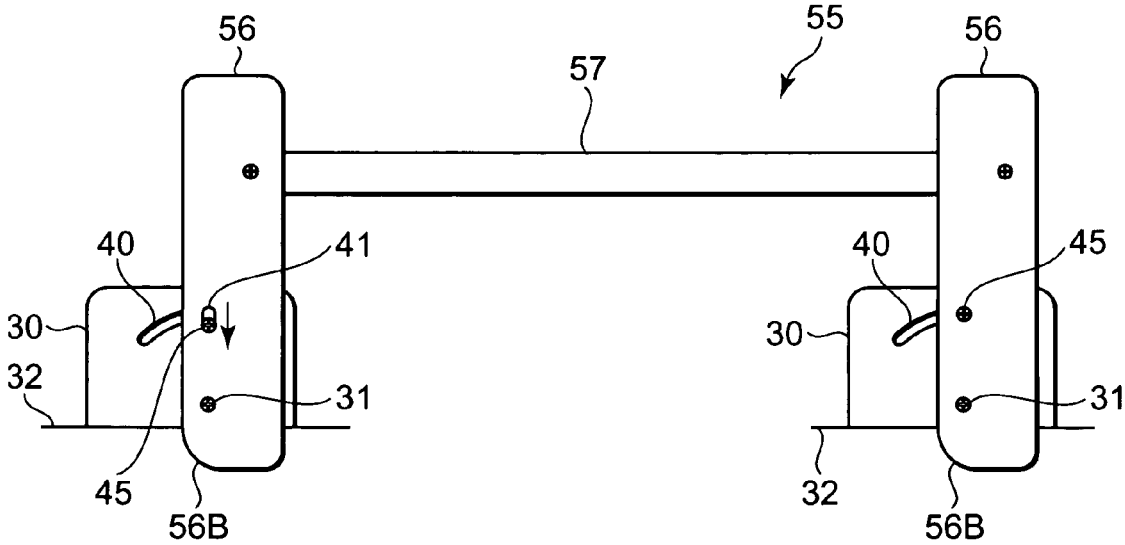
FIG. 9 is a side view of an upright state of the push-up arm of the push-up mechanism of the cooling unit of FIG. 2.

Next, the push-up arms 56, 56 of both front sides are rotated clockwise in FIG. 2 by pushing back the upper parts thereof. At this time, the mounting base 32 abuts on the stoppers 51, whereby its backward positional shifting is prevented. As the rear push-up arms 56, 56 are rotated in association by the link arms 57, the push-up arms 56 of the four corners are rotated roughly simultaneously, and the cam face 56B downwardly projects from the mounting base 32 to abut on the rail 62. Then, as the push-up arms are further rotated, an increase in projection amount of the cam face 56B is accompanied by lifting of the cooling unit R at the four corners based on a principle of leverage. The cooling unit R is smoothly raised in a parallel state by a relatively small force, and the lifting comes to an end before long at a point of time when each push-up arm 56 is set upright (FIGS. 8, 9).

At a point of this time, the sealing material 29 is brought into close contact with and pressed to the bottom wall lower surface of the insulating box 2, and the cold air inlet 27 and the cold air outlet 28 of the cooling box 22 are communicated with the cold air inlet 19 and the cold air outlet 20 formed in the bottom wall of the insulating box 2. Accordingly, it is possible to cool the inside of the storing chamber 6 by mounting the cooling unit R including the compressor 33, the condenser 34, the cooling box 22, and the like integrated therein to the bottom wall of the insulating box 2 without any difficulties, and forming cold air circulation of discharging cold air heat-exchanged with the evaporator 24 through the cold air outlet 20 into the storing chamber 6 by the blower 25 for the evaporator and sucking the cold air through the cold air inlet 19 into the cooling chamber 23.

In this case, especially, the push-up arm 56 of the push-up mechanism 55 downwardly projects from the mounting base 32 to push up the cooling unit R toward the bottom wall of the insulating box 2, and the cooling box 22 is brought into close contact with the bottom wall, whereby processing such as railing on the bottom wall of the insulating box 2 can be made unnecessary. Thus, it is possible to integrate standards, and to save space because of no rail, or the like on the insulating box 2 side.

The guide shaft 45 moves in the guide groove 40, and thus the push-up arm 56 is stably rotated. Especially, in the upright state of the push-up arm 56, the through-hole 41 (long hole) of the front push-up arm 56 coincides with the engaging groove 40A of the guide groove 40. Accordingly, the guide shaft 45 of the front push-up arm 56 is lowered as shown in FIG. 9 to be engaged in the engaging groove 40A, thereby inhibiting rotation of the push-up arm 56 in this state. Thus, a pushed-up state of the cooling unit R is stably maintained, and a problem of careless rotation and falling of the push-up arm 56 is prevented.

Furthermore, when the cooling unit R is removed from the insulating box 2 for maintenance, the guide shaft 45 engaged with the engaging groove 40A is lifted to enable rotation of the push-up arm 56. Next, the push-up arm 56 is rotated counterclockwise shown in FIG. 8, whereby the cooling unit R is lowered as shown in FIG. 6, and separated from the bottom wall of the insulating box 2. In this case, a friction coefficient is set large between the guide groove 40 and the guide shaft 45 as described above. Thus, it is possible to prevent a problem of sudden falling of the cooling unit R caused by sudden rotation of the push-up arm 56.

(Embodiment 2)

Figure 10:
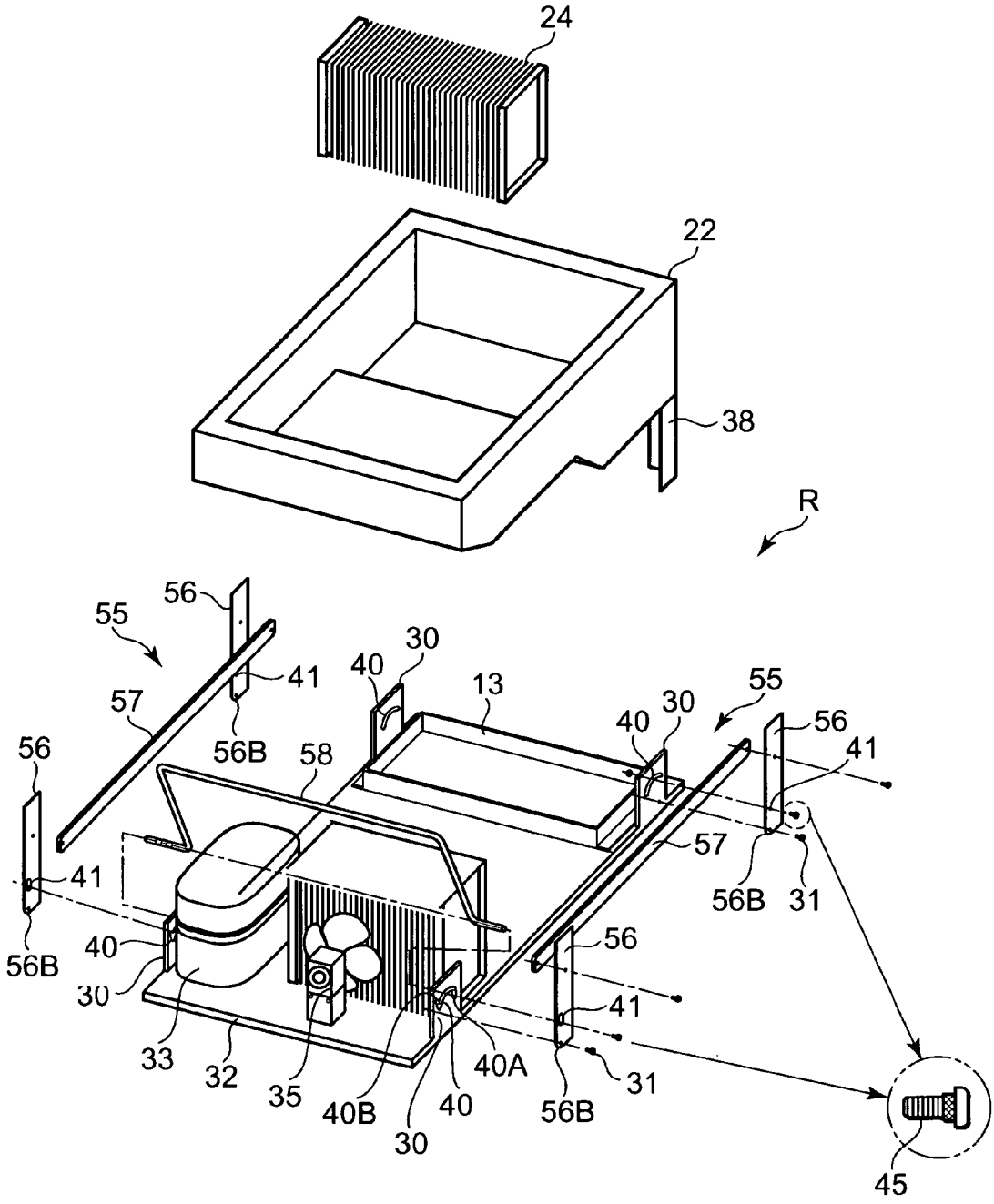
FIG. 10 is an exploded perspective view of a cooling unit of a cold storage according to another embodiment of the present invention.

Next, referring to FIGS. 10 to 14, another embodiment of the present invention will be described. In this case, a cooling unit R comprises a handle 58 for operating push-up arms 56, 56 of both front sides in association. As shown in FIG. 10, the handle 58 is roughly formed into a gate shape as a whole. Tips of guide shafts 45, 45 passed through guide grooves 40 are engaged with both end surfaces thereof and fixed, and the handle 58 itself is arranged before a compressor 33. In a front end of the guide groove 40 of each of support portions 30 of both front sides, an engaging groove 40B is continuously formed obliquely forward and upward. The guide shaft 45 can movably be engaged in the engaging groove 40B. Other components are similar to those shown in FIGS. 1 to 9.

Figure 11:
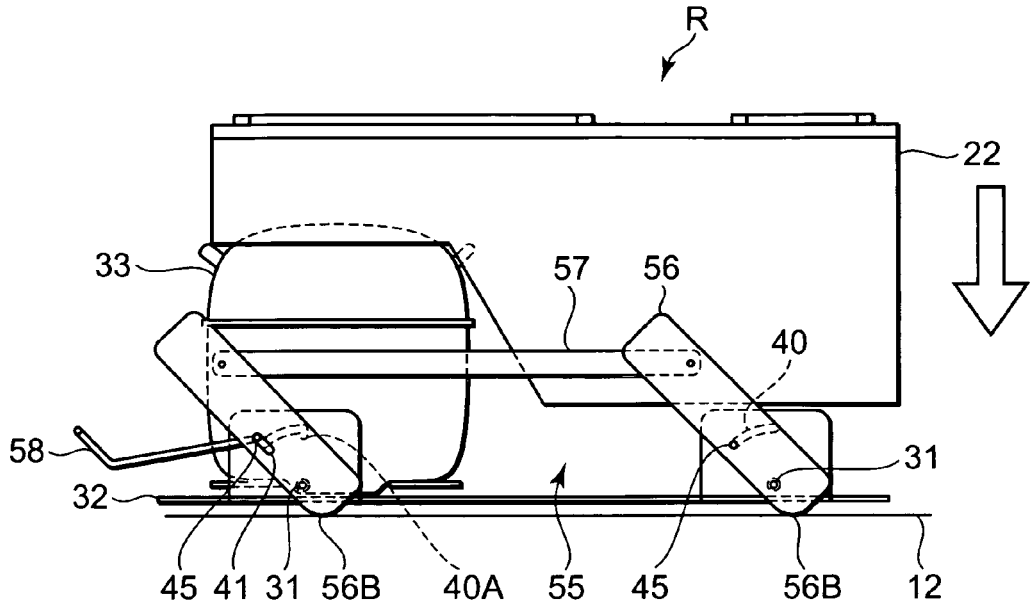
FIG. 11 is a side view of a lowered state of the cooling unit of FIG. 10.
Figure 12:
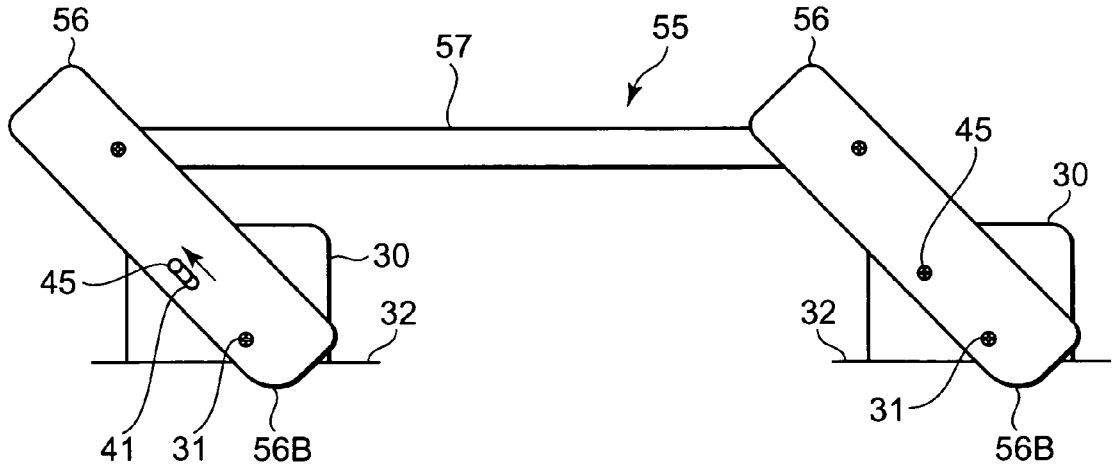
FIG. 12 is a side view of an inclined state of a push-up arm of a push-up mechanism of the cooling unit of FIG. 10.
Figure 13:
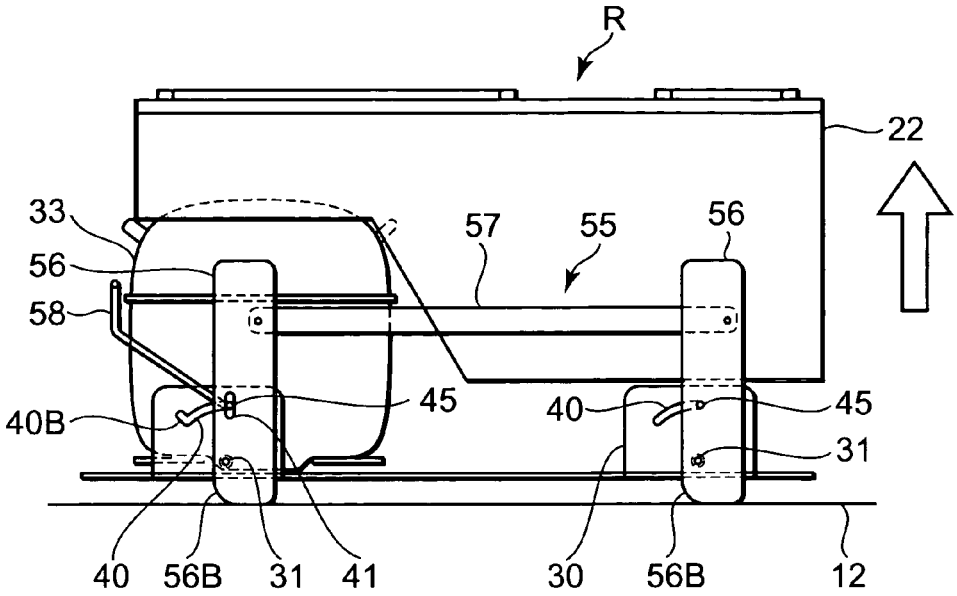
FIG. 13 is a side view of a raised state of the cooling unit of FIG. 10.
Figure 14:
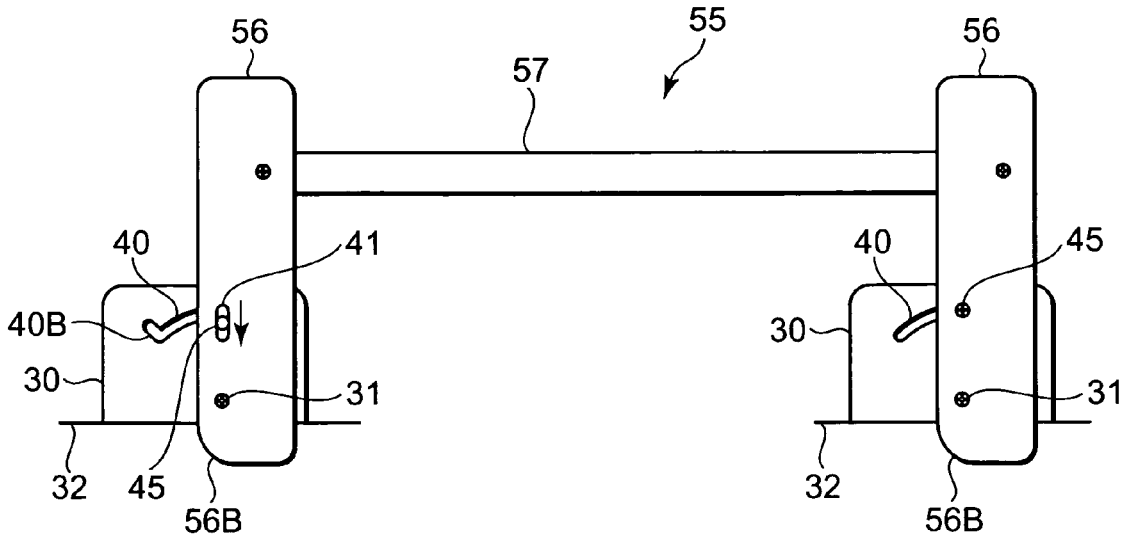
FIG. 14 is a side view of an upright state of the push-up arm of the push-up mechanism of the cooling unit of FIG. 10.

Thus, by fixing the guide shafts 45, 45 of both front sides to both ends of the handle 58, the handle 58 is held and pushed back in, and the push-up arms 56, 56 of both front sides are rotated clockwise shown in FIGS. 11, 12, whereby the cooling unit R is lifted roughly simultaneously at four corners. A tip of the handle 5 is lifted to move the guide shaft 45 out of the engaging groove 40A, and the handle 58 is pulled to rotate the push-up arms 56, 56 of both front sides counterclockwise shown in FIGS. 13, 14, thereby lowering the four corners of the cooling unit R simultaneously. Thus, it is possible to greatly improve operability.

Furthermore, when the single cooling unit R is carried, the cooling unit R can be carried in a suspended state by holding the handle 58. In this case, since the guide shaft 45 enters the engaging groove 40B of the front end of the guide groove 40 and is engaged, both ends of the handle 58 are fixed to the engaging groove 40B. Thus, it is possible to stabilize the handle 58 when the cooling unit R is carried.

What is claimed is:

1. A cold storage in which a machine chamber is disposed below a storing chamber in an insulating box, comprising:

a cooling unit in which a cooling box receiving an evaporator and a blower in a cooling chamber having an opened upper surface, a compressor, and a condenser are integrally disposed on a mounting base; and a cold air outlet and a cold air inlet formed in a bottom wall of the insulating box which becomes a ceiling of the machine chamber to communicate the inside of the storing chamber with the inside of the machine chamber, the cooling unit being provided with a push-up mechanism which is disposed to downwardly project from the mounting base, the push-up mechanism comprising support portions on the mounting base and push-up arms rotatably mounted to the support portions and positioned on both sides of the mounting base, thereby pushing up the cooling unit toward the bottom wall, and to bring the cooling box into close contact with the bottom wall, thereby communicating the cold air outlet and the cold air inlet with the inside of the cooling chamber.

2. The cold storage according to claim 1, wherein the push-up mechanism is provided with holding means which holds the close contact state of the cooling box to the bottom wall.

3. The cold storage according to claim 1, wherein both lower sides of the machine chamber comprise rails on which the push-up mechanism abuts and which prevent horizontal shifting of the mounting base.

4. The cold storage according to claim 1, wherein the cooling box is supported by the condenser.

5. The cold storage according to claim 1, wherein a blower for the condenser is disposed in an end of the mounting base to ventilate the condenser, and a perforated fan cover is mounted to the blower for the condenser.

6. A cold storage in which a machine chamber is disposed below a storing chamber in an insulating box, comprising:

a cooling unit in which a cooling box receiving an evaporator and a blower in a cooling chamber having an opened upper surface, a compressor, and a condenser are integrally disposed on a mounting base; and a cold air outlet and a cold air inlet formed in a bottom wall of the insulating box which becomes a ceiling of the machine chamber to communicate the inside of the storing chamber with the inside of the machine chamber, the cooling unit being provided with a push-up mechanism which is disposed to downwardly project from the mounting base, thereby pushing up the cooling unit toward the bottom wall, and to bring the cooling box into close contact with the bottom wall, thereby communicating the cold air outlet and the cold air inlet with the inside of the cooling chamber, wherein:

the push-up mechanism comprises support portions disposed in the mounting base, and push-up arms rotatably mounted to the support portions by lower rotary shafts and positioned on both sides of the mounting base, and each push-up arm comprises a cam face having a changeable radius from the rotary shaft and downwardly projecting from the mounting base, and the push-up arm is upright by being rotated and pushes up the cooling unit when the cam face of a portion increased in radius from the rotary shaft comes directly below the rotary shaft.

7. The cold storage according to claim 6, wherein a circular-arc guide groove is formed around the rotary shaft in each support portion, and a guide shaft movably engaged with the guide groove is disposed in each push-up arm.

8. The cold storage according to claim 7, wherein:

an engaging groove is continuously formed downward in one end of the guide groove, a long hole is formed in an upright state in an up-and-down direction in the push-up arm, the guide shaft is movably engaged in the long hole, and in an upright state of the push-up arm, the guide shaft is lowered, and enters the engaging groove and engages with the same.

9. The cold storage according to claim 7, wherein a friction coefficient is set large between the guide shaft and the guide groove.

10. The cold storage according to claim 6, wherein the push-up arms are positioned at four corners of the mounting base, and the push-up arms positioned in front and rear parts are connected to each other by a link arm.

11. The cold storage according to claim 10, further comprising a handle for operating the push-up arms positioned on both sides of the mounting base in association.

12. The cooling chamber according to claim 11, wherein in the other end of the guide groove, an engaging groove which the guide shaft enters is continuously formed upward, and the guide shafts are positioned in both ends of the handle.

13. The cold storage according to claim 6, wherein the machine chamber comprises a stopper which is positioned in a rotational direction for erecting the push-up arm, and on which the mounting base abuts in a state in which the cooling box corresponds to the cold air outlet and the cold air inlet.

* * * * *